United States Patent [19]

Rinfret et al.

[11] Patent Number: 4,573,852

[45] Date of Patent: Mar. 4, 1986

[54] VIAL RUPTURING APPARATUS

[76] Inventors: John H. T. Rinfret; Elizabeth M. Rinfret, both of Grange Farm, Farthorpe, West Ashby, Horncastle, Lincolnshire, United Kingdom

[21] Appl. No.: 693,822

[22] Filed: Jan. 23, 1985

Related U.S. Application Data

[63] Continuation of Ser. No. 407,938, Aug. 13, 1982, abandoned.

[30] Foreign Application Priority Data

Aug. 13, 1981 [GB] United Kingdom ..... 8124807

[51] Int. Cl.[4] ..... B65B 69/00

[52] U.S. Cl. ..... 414/412; 222/87

[58] Field of Search ..... 83/660, 636, 697; 222/80, 81, 87; 100/94; 30/444; 414/412

[56] References Cited

U.S. PATENT DOCUMENTS

| | | | |
|---|---|---|---|
| 1,376,798 | 5/1921 | Courtney | 414/412 |
| 1,469,398 | 10/1923 | Street | 222/87 |
| 2,596,432 | 5/1952 | Pietzch | 414/412 |
| 2,622,316 | 12/1952 | Borland | 222/87 |
| 2,772,009 | 11/1956 | Plusquellic . | |
| 3,487,965 | 1/1970 | Gale . | |
| 3,835,768 | 9/1974 | Kidson | 222/87 |
| 3,939,998 | 2/1976 | Soltermann | 414/412 |
| 4,119,227 | 10/1978 | Hafner et al. | 414/412 |

*Primary Examiner*—H. Grant Skaggs

*Attorney, Agent, or Firm*—Watson, Cole, Grindle & Watson

[57] ABSTRACT

Vial rupturing apparatus is disclosed for destroying vials, typically small medicinal vials. Each vial is split longitudinally by a thin vertical blade while the vial is maintained horizontal. This is done either by moving the blade while holding the vial or by urging the vial onto a stationary blade.

9 Claims, 5 Drawing Figures

VIAL RUPTURING APPARATUS

This application is a continuation application of application Ser. No. 407,938, filed Aug. 13, 1982, now abandoned.

This invention relates to vial rupturing apparatus.

It is quite easy to destroy glass vessels and bottles because glass is frangible and, depending upon the severity of the knock, it will fracture. It is more difficult to destroy items made of plastic because plastic is generally a tougher material which has different properties according to its particular kind. Mainly it is brittle or flexible. Plastic bottles and vessels will have various properties to suit the purpose for which they are made.

In the pharmaceutical industry and in research laboratories there is a need to retrieve liquids, such as outdated drugs and toxic solvents, from their containers in order to dispose of them correctly. The usual method is to do this work by hand, e.g., by uncapping the vessels and pouring out the liquids. However, this procedure is not only laborious and often unpleasant, but potentially hazardous. By rupturing the containers in a suitable machine and allowing the liquid to be drained from the debris, the work can be done more safely and efficiently.

Using any granulator or sawing action is not satisfactory because heat is generated which can melt the plastic which will gum up the moving parts when the machine stops and cools. As some liquids are very volatile, heat would add to the hazard of retrieval. Crushing vessels by compression may cause them to burst but can still leave too much liquid within the flattened bottle.

The present invention provides vial rupturing apparatus which overcomes the noted drawbacks in other apparatus. It comprises a rupturing member, means for locating a vial to be ruptured with an axis of the vial generally horizontal, means for limiting movement of the vial relative to the rupturing member along the axis in one direction, and means for moving the limiting means and rupturing member relative to one another generally along the axis whereby to rupture the vial.

The relative moving means may maintain the vial stationary while it is ruptured or, alternatively, the rupturing member may be mounted rigidly in the apparatus.

The rupturing member is preferably formed with a point for piercing the vial, and may be forked to present two points for piercing the vial.

The rupturing member may conveniently be a knife blade, particularly for dealing with vials of plastic materials. This knife blade may be generally flat and can for example be maintained in a generally vertical plane while the vial is ruptured. The limiting means can allow the knife blade to cut the vial completely, this being achieved for example by a slotted end stop comprised by the limiting means and against which the vial abuts, in use, while being cut, such that the blade can pass into the slot.

Rather than being a flat blade, the rupturing member may be generally tubular, means being provided for withdrawing contents of the vial through the member after the vial has been ruptured.

The relative moving means may comprise a pneumatic or hydraulic ram. Where the rupturing member is movable, it may be secured to the plunger of such a ram. Alternatively or additionally, the relative moving means may be manually operable.

The locating means preferably defines a generally V-shape channel in which the vial, in use, is located. The rupturing member may pass along the channel to rupture the vial and where the rupturing member is a vertical knife blade, the channel may be divided longitudinally to permit the knife blade to pass therethrough.

The apparatus may further comprise a chute for guiding vials to be ruptured to the locating means. Also, means may be provided for separating the ruptured vial from liquid released therefrom.

DESCRIPTION OF THE DRAWINGS

Embodiments of the invention will now be described, by way of example, with reference to the accompanying drawings, in which.

DESCRIPTION OF THE PREFERRED EMBODIMENTS

Figure 1:
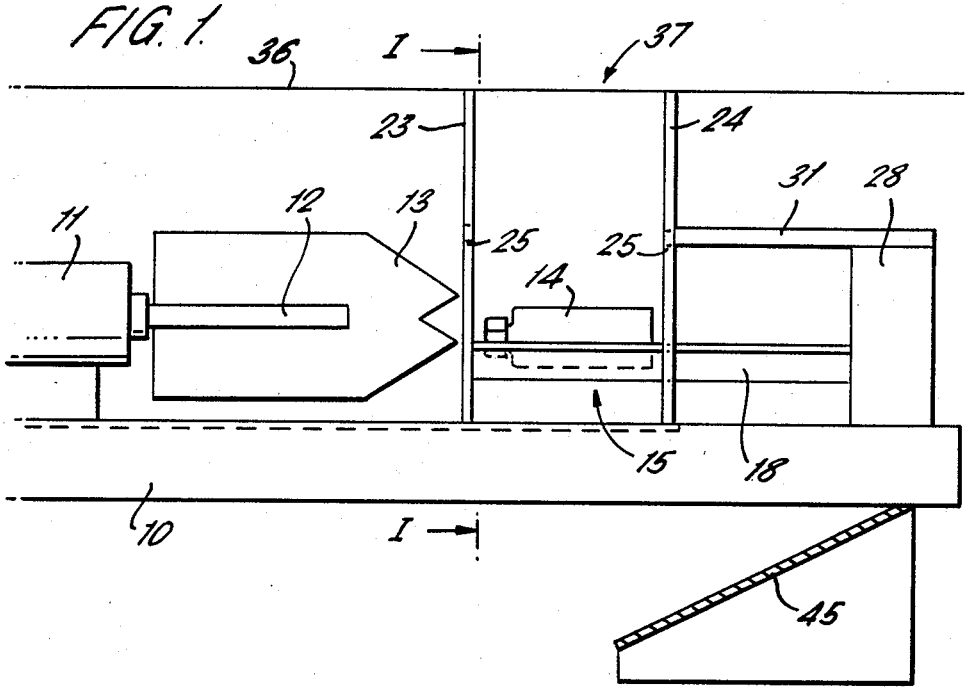
FIG. 1 is a sectional view of vial splitting apparatus embodying the invention.

The apparatus comprises a firm base 10 onto one end of which is mounted a cylinder 11 of a pneumatic ram (distance reducing means) whose piston moves horizontally parallel to the base towards the other end. Onto the end of the piston is fitted a blade holder 12 with knife blade 13 which is flat, double sided and sharpened along all edges. The flat blade 13 is vertically oriented. When the piston is in the fully retracted position, the tips of the blade are close to the end of a support means or locator 15 which receives the vials to be split, i.e., so as to be horizontally ready for the forward motion of the blade 13.

The locator 15 comprises two bars 17, 18 which are mounted at right angles to each other to form an open based V-shaped channel along which the bottom edge of the blade 13 can slide. The channel serves to locate a vial 14 longitudinally of the cylinder axis and to maintain it parallel thereto during splitting. Flat sheets 20, 21 are welded to the bars to increase the size of the "V", the sheet 21 acting as a chute to guide vials to the locator 15. The length of the channel is made slightly longer than double the length of a vial 14. It is divided into half by two dividing plates 23, 24, one at the end near the retracted blade tips and one at the middle. These plates have generally rectangular holes 25 cut into them to allow the bars 17, 18 to pass through and to be supported by being welded to the sides. The holes are large enough to allow the passage of a single vial pushed along the channel. The holes could also be of other shapes such as round. The furthest end of the bars is supported by an abutment means in the form of two pillars 27,28 forming a slotted end stop to limit movement of the vial. Between the pillars and the middle plate two other bars 30, 31 are supported above the channel so that the top edge of the blade 13 passes between them. These are spaced above the channel so that sufficient space remains for the largest diameter of vial to fall away from the blade 13 once it has been split. The effect of the channel and top runner bars 30, 31 is to guide the blade 13 and the vial 14, so that the cutting edge of the blade will be forced to slice through the vial into which it is pushing.

In use the mechanism is mounted within a steel cabinet 35 a little below the top tray (lid) 36. A hole 37 in the tray aligns with the locator 15 and in front of this is mounted a shoe 40 with a sloping base 41 to allow vials to be placed into it so that they can roll down along the slope and out through the lower end and into the locator 15. Only one vial 14 at a time can lie horizontally in the channel, the rest stack up the sheet 21 to the shoe 40. A vial 14 lies in a position so that either end is offered to the blade. A cassette 43 with inclined ledges 44 can be engaged in the shoe; loaded in advance with vials, it will be appreciated that the cassette feeds the vials automatically for splitting.

In operation, the cylinder of the ram moves the forward blade towards the limiting end stop and the tips push the vial 14 through the middle plate 24 until it is arrested by the pillars 27, 28. The blade continues forward, first piercing the end of the vial 14 and, having ruptured the vial, it continues longitudinally of the vial along the full length of the vial 14 and enters between the pillars 27, 28. As it does so the blade holder 12, which is bevelled at the end holding the blade, enters the sliced vial 14 and widens the split of the two halves to ensure that they fall away from the blade 13 and out of the channel. The halves fall onto a perforated sloping screen 45 to separate the liquid before they fall into a collecting bin.

No other vials can fall into the locator 15 whilst the blade and holder are in the forward position-they can only do so when the blade is fully retracted. The blade is forked, having two points which are so positioned that the lower point aligns with the centre of the smallest diameter of vial to be used in the machine. The inverse Vee between the points tends to keep the smaller vials from moving upwards. With bigger vials the two points come just within their outer diameter. The advantage of this feature is that it allows the slope of the edges of the blade to be more gradual and minimises the forward effort to slice the vial. In this way it lessens the chance of the vial collapsing before being completely sliced in half.

The above embodiment of the invention has the advantage of providing apparatus which simply and quickly retrieves the contents of vials made of various plastic materials by slitting the vials in half longitudinally. This simple cutting in half of the vials has advantages over other methods of destruction as there is no requirement to reduce the plastic to fragments.

The apparatus is particularly suitable for small medicinal and chemical vials, but it can of course be adapted for larger containers and vessels. Thus the term "vial" is intended not to be construed in a limiting sense in this specification but to include such larger vessels and containers.

By piercing the vial at the end and allowing the blade to enter in that way, the vial is slit from the inside outwards as its skin is stretched over the ever increasing width of the blade which ultimately passes through the two top and bottom channels to prevent the skin stretching any more. This will still work even when the blade is blunted. The blade inside the vial also acts as a guide to assist the vee section in preventing the vial moving out of alignment. This is as opposed to cutting by means of a straight chisel edge, which depends upon the rigidity of the walls of the vial and the sharpness of the cutting edge: any collapse of the vial could make it move or spring out of alignment with pillars 27 and 28 and not be slit at all. If it did remain in correct position the vial could concertina and little cutting would take place until the vial was firmly compressed-this would give a very much greater resistance to the blade and would require very much greater effort, resulting in the need for a stronger and therefore larger machine.

The apparatus is particularly suitable for generally cylindrical vials but it is also envisaged that non-cylindrical vials could be dealt with; in the latter case, the locating means will merely serve to orient some longitudinal axis of the vial relative to the rupturing member. Likewise, although the knife form of rupturing member is effective for dealing with plastic vials, the apparatus may be adapted for crushing glass vials by using a blunter rupturing member at either end of the machine.

The apparatus can be used merely to reduce the volume of used vials by their destruction when it is not required to recover the contents of the vials.

The dividing plate 24 and end pillars 27, 28 may be made movable towards and away from the dividing plate 23 so that different lengths of vials can be accepted by the locator. The blade holder 12 may be adapted to accept an interchange of different types of blades or other rupturing members; for example, the blade holder might have a blunt end with a slit in it. The blade could be fixed in a permanent position in the splitting area in which case the abutment (pillars 27,28 in the embodiment) would be movable to push the vial onto the blade.

The overall length of the bars 17, 18 could be reduced so that they did not reach end pillars 27, 28, thus leaving a gap between their ends and the pillars. This gap would typically be shorter than half the length of the shortest vial to be supported in the splitting area. This gap would then allow the debris from mainly frangible cylindrical vials that may be crushed in the unit to fall out and away from the V-section channel.

By using a square or round hollow tubular blade, the contents of vials such as aerosol cans can be exhausted through the blade after the vial has been pierced. By allowing the stroke of the cylinder to progress further forward, the can itself could be fully compressed so that upon retraction of the blade, or the abutment, the can would fall through the gap. The blade could be held stationary during rupturing while being mounted movably to be withdrawn from the can after compression thereof, again to allow the can to fall through the gap. By adjusting the speed of stroke, it could be arranged that the rupturing was carried out very slowly so that if a vacuum pump were fitted to the piercing blade, the contents could be sucked out before the vial was cut or the aerosol can compressed.

The piercing blade could have a wider collar along its length (or like a countersinking bit) which would also pass through the skin of the end of the can so that the can could be withdrawn to a "dropping zone" if it was not to be compressed. Similarly, a washer could be located on the piercer to seal the hole as the contents were sucked out through the piercer.

It should be noted that the square or round hole in the dividing plate 24 should be just big enough to allow one vial through, as it thus prevents the next vial up the chute 21 from moving forward with the bottom vial. The size of this hole could be adjustable by use of a sliding plate on the back of it.

Figure 2:
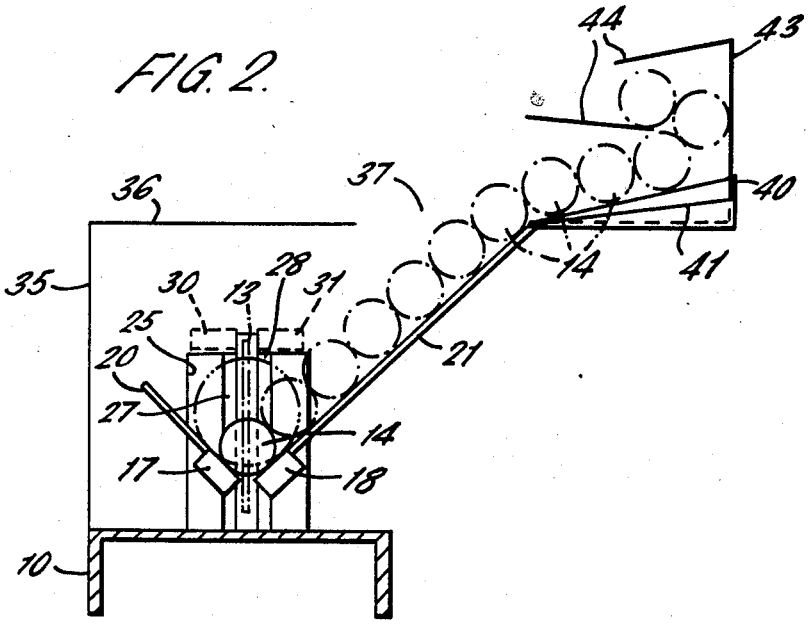
FIG. 2 is a sectional elevation of the same apparatus taken along the line I—I of FIG. 1.
Figure 3:
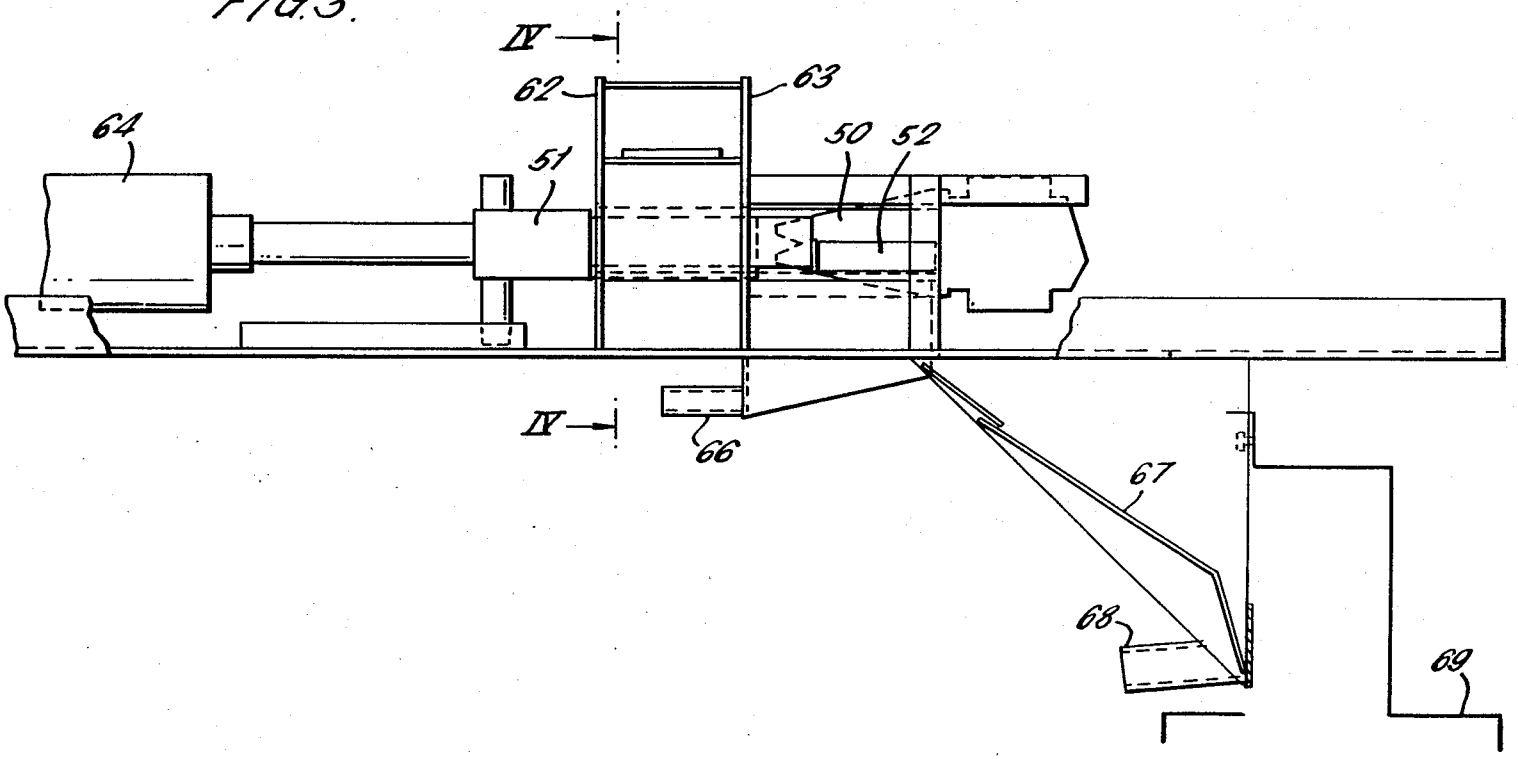
FIG. 3 is a partially cut-away elevation of a second vial splitting apparatus embodying the invention.
Figure 5:
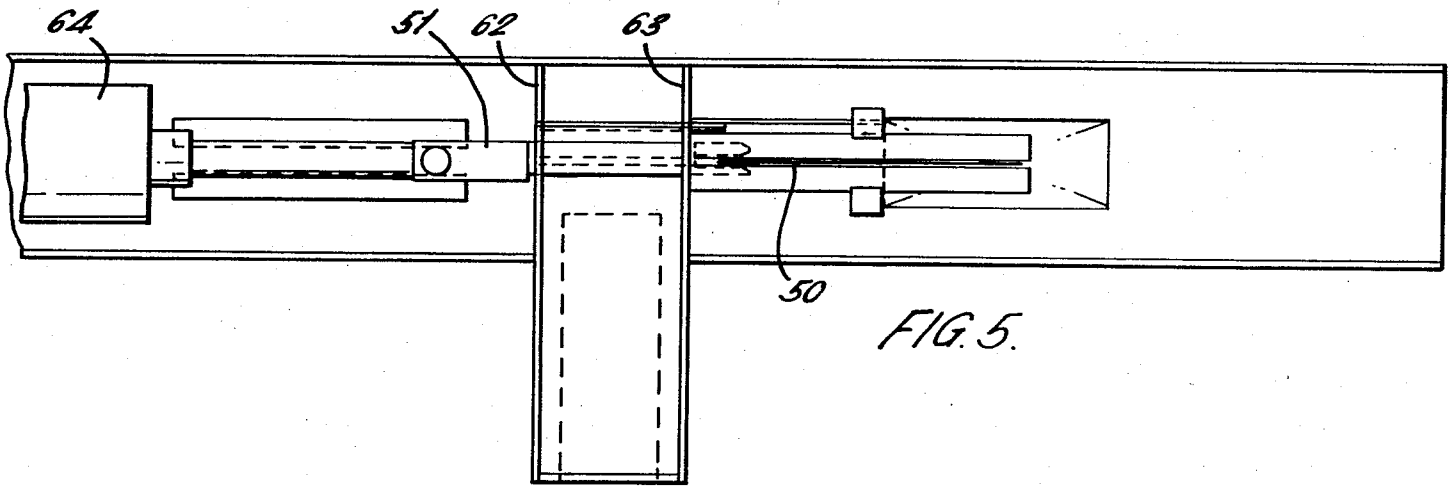
FIG. 5 is a plan view of the apparatus of FIG. 3.
Figure 4:
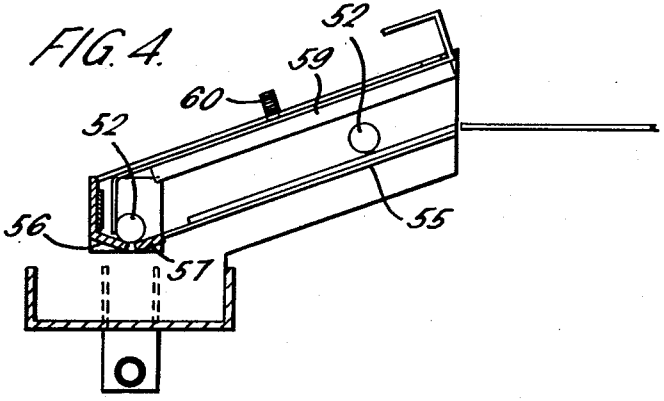
FIG. 4 is a sectional elevation of the apparatus of FIG. 3 taken along the line IV—IV.

FIGS. 3 to 5 show an embodiment similar in many respects to the embodiment of FIGS. 1 and 2 but in which the knife blade 50, which is again flat and in a vertical plane, is mounted rigidly in the apparatus. A ram head 51, which in this case acts as an abutment means, urges a vial 52 onto the blade thereby to split the vial in a similar manner to the first embodiment.

The vials 52, typically "scintillation" vials, roll down a chute 55 and are located in a support means in the form of a shallow vee-shaped channel formed by two members 56 and 57. In FIG. 4 the chute 55 is shown with the addition of stop plate 59 which provides means to restrict the interior of the chute when small vials are being processed so that they do not tumble over one another. The lower end of the stop plate 59 is bent downwardly to retain the vial to be split centrally of the channel and of the blade. The stop plate 59 is removably attached to the chute 55 by means of a screwed stud 60 fixed to the plate 59 and passing through a hole in the chute 55. A nut (not shown) is then tightened on the stud against the chute.

The sides of the chute are plates 62, 63 formed with apertures to allow passage of the ram head 51, and ram head and vial, respectively.

The ram head 51 is secured to the piston of a pneumatic ram having a cylinder 64, the ram acting to move the ram head 51 relative to the knife blade 50. The ram head pushes the vial 52 along the channel onto the blade 50 until the position shown in FIG. 3. Initial discharge of liquid from the vial takes place and this liquid is removed through a gully 66. The ram head is then retracted, allowing the next vial to fall into the channel. The ram head is advanced again to split this next vial, thus pushing the debris from the first vial over the back end of the channel and onto a punched screen 67, more liquid being drained off through a conduit 68. The debris collects in a bin 69.

The forked blade again has the advantage of being able to cope with small and large vials, the upper limb in the case of small vials helping to keep the vials from springing upwards.

The vial can be located, for rupturing, on its side at any chosen angle to the horizontal, and may indeed be located with its longitudinal axis vertical.

We claim:

1. An apparatus for rupturing an elongated plastic vial which has opposite first and second ends and a longitudinal central axis therethrough, said apparatus comprising a support means comprising a pair of parallel, horizontally-oriented bars for supporting said elongated vial such that said longitudinal axis thereof is generally horizontally oriented, said bars defining a drainage channel therebetween, a rupturing means for rupturing said elongated vial in parallel with its longitudinal central axis, said rupturing means consisting of a blade holder and a knife blade, said knife blade extending beyond said blade holder and towards the first end of said elongated vial, said knife blade having a sharpened edge facing said first end of said elongated vial, an abutment means for contacting the second end of said elongated vial and preventing said elongated vial from sliding in a direction parallel to its longitudinal central axis as the knife blade of said rupturing means moves through said vial, distance-reducing means for reducing the distance between said rupturing means and said abutment means to cause the knife blade of said rupturing means to rupture said elongated vial in parallel with its longitudinal central axis, an upwardly-oriented flat sheet having an upper edge and a lower edge, the lower edge being connected to one of said pair of parallel, horizontally-oriented bars, and a cassette means connected to the upper edge of said flat sheet, said cassette discharging individual elongated plastic vials onto said flat sheet to roll therealong into position on said pair of parallel, horizontally-oriented bars.

2. The apparatus as defined in claim 1, wherein said abutment means is stationarily mounted and wherein said distance-reducing means is connected to said rupturing means to move said rupturing means toward said abutment means.

3. The apparatus as defined in claim 2, wherein said distance-reducing means comprises a pneumatic ram, said pneumatic ram including a cylinder and a piston movable therein, said piston being connected to said blade holder.

4. The apparatus as defined in claim 1, wherein said rupturing means is stationarily mounted and wherein said movement means is connected to said abutment means to move it toward said rupturing means.

5. The apparatus as defined in claim 1, wherein said abutment means comprises a pair of parallel, vertically-oriented pillars.

6. The apparatus as defined in claim 1, wherein said knife blade is planar.

7. The apparatus as defined in claim 19, wherein said planar knife blade is mounted on said blade holder to be vertically oriented.

8. The apparatus as defined in claim 1, wherein said pair of parallel, horizontally-oriented bars together define a generally V-shaped support surface in which each said elongated vial can rest.

9. The apparatus as defined in claim 1, wherein said knife blade is vertically oriented and a portion of said knife blade extends into said drainage channel.

* * * * *